US009162793B2

(12) United States Patent
Stewart et al.

(10) Patent No.: US 9,162,793 B2
(45) Date of Patent: Oct. 20, 2015

(54) CARTON

(75) Inventors: Noel G. Stewart, Cumming, GA (US); Scott C. Biondich, Alpharetta, GA (US); Caroline Marie Kibler, Atlanta, GA (US); Lynwood M. Mallard, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 295 days.

(21) Appl. No.: 13/480,694

(22) Filed: May 25, 2012

(65) Prior Publication Data

US 2012/0298732 A1 Nov. 29, 2012

Related U.S. Application Data

(60) Provisional application No. 61/489,738, filed on May 25, 2011.

(51) Int. Cl.

| | |
|---|---|
| ***B65D 5/00*** | (2006.01) |
| ***B65D 5/54*** | (2006.01) |
| ***B65D 5/72*** | (2006.01) |
| *B65D 71/36* | (2006.01) |
| *B65D 5/468* | (2006.01) |

(52) U.S. Cl.

CPC ..... *B65D 5/542* (2013.01); *B65D 5/724* (2013.01); *B65D 5/4608* (2013.01); *B65D 71/36* (2013.01); *B65D 2571/0058* (2013.01); *B65D 2571/00574* (2013.01); *B65D 2571/00623* (2013.01)

(58) Field of Classification Search

CPC ..... B65D 71/36; B65D 2571/0058; B65D 2571/00574; B65D 2571/00623; B65D 5/4608

USPC ..... 229/243, 117.13, 920, 244, 238; 206/738, 170, 750; 221/302

See application file for complete search history.

(56) References Cited

U.S. PATENT DOCUMENTS

| | | | | |
|---|---|---|---|---|
| 3,178,242 | A * | 4/1965 | Ellis et al. | 312/45 |
| 3,469,766 | A | 9/1969 | Nelson | |
| 4,340,170 | A | 7/1982 | Montealegre | |
| 4,566,593 | A | 1/1986 | Muller | |
| 6,073,833 | A | 6/2000 | Deorosiers et al. | |
| 6,250,542 | B1 | 6/2001 | Negelen | |
| 6,435,351 | B1 | 8/2002 | Gibb | |
| 7,059,494 | B2 * | 6/2006 | Harrelson et al. | 221/92 |
| 7,337,942 | B2 | 3/2008 | Wang | |
| 7,699,213 | B2 * | 4/2010 | DeBusk et al. | 229/122.1 |
| 2004/0089671 | A1 * | 5/2004 | Miller | 221/305 |
| 2004/0232214 | A1 * | 11/2004 | Bates | 229/122.1 |
| 2006/0054522 | A1 | 3/2006 | Kline et al. | |
| 2006/0081692 | A1 | 4/2006 | Stewart et al. | |
| 2006/0091191 | A1 | 5/2006 | DeBusk | |
| 2006/0108406 | A1 | 5/2006 | Stewart et al. | |
| 2007/0007325 | A1 | 1/2007 | Suzuki et al. | |
| 2007/0029220 | A1 | 2/2007 | Bradford et al. | |
| 2007/0090175 | A1 | 4/2007 | Schemmel | |
| 2007/0164093 | A1 * | 7/2007 | Spivey et al. | 229/122 |
| 2007/0290026 | A1 | 12/2007 | Kastanek et al. | |
| 2008/0078820 | A1 | 4/2008 | Stewart et al. | |
| 2008/0128479 | A1 | 6/2008 | Bates et al. | |
| 2011/0233091 | A1 * | 9/2011 | Block et al. | 206/427 |

* cited by examiner

*Primary Examiner* — Christopher Demeree

(74) *Attorney, Agent, or Firm* — Sutherland Asbill & Brennan LLP

(57) ABSTRACT

The present application and the resultant patent provide a carton for a number of articles. The carton may include a top wall, a pair of sidewalls, a rear wall, and a dispenser section. The dispenser section may extend along a top wall portion of the top wall, a side wall portion of each of the pair of sidewalls, and the rear wall.

14 Claims, 3 Drawing Sheets

CARTON

RELATED APPLICATIONS

The present application is a non-provisional application claiming priority to U.S. Provisional Application Ser. No. 61/489,738, filed on May 25, 2011, entitled "Carton". U.S. Provisional Application Ser. No. 61/489,738 is incorporated herein by reference in full.

TECHNICAL FIELD

The present application and the resultant patent relate generally to a carton and more particularly relate to a carton sized for a conventional refrigerator shelf with a contoured dispenser section so as to provide support and easy access to the articles therein.

BACKGROUND OF THE INVENTION

Various types of cartons are known for enclosing different types of articles such as cans, bottles, and other objects. One popular type of container in the beverage industry is known as the "FRIDGE PACK™" carton. For example, various types of "FRIDGE PACK™" cartons are produced for and sold by or under license to The Coca-Cola Company of Atlanta, Ga. The "FRIDGE PACK™" cartons thus promote the sale of Coca-Cola® brand products and similar items therein. Various types of "FRIDGE PACK™" carton designs may be known in different sizes, shapes, and configurations and for different types of articles.

The "FRIDGE PACK™" cartons generally have a two by six (2×6) product configuration, with two (2) product columns in width and six (6) product rows in length. One end of the carton generally may be scored so as to permit the removal of a dispenser section. Once the dispenser section is opened and/or removed, a consumer may grasp and remove the products therein. The design of two (2) product columns and six (6) product rows with removable a dispenser section generally promotes the use of the carton within a standard refrigerator shelf and the like. Other configurations also may be known.

A further recent development in the beverage industry has been the introduction of mini-cans. Mini-cans generally provide about 7.5 ounces (about 0.22 liters) of a beverage as opposed to the conventional 12 ounce can (about 0.35 liters). As a result, the calories consumed by a consumer likewise are reduced. For example, a carbonated soft drink in a 7.5 ounce mini-can may contain about ninety (90) calories or so. Other sizes and volumes also may be used. Other types of containers also may be used.

There is thus a desire to adapt the "FRIDGE PACK™" carton concept and the like to the use of mini-cans. Such a carton may conveniently transport and store such mini-cans while also providing ease of access thereto. The "FRIDGE PACK™" carton concept likewise may leverage and promote existing brand identity in effective and unique ways.

SUMMARY OF THE INVENTION

The present application and the resultant patent thus provide a carton for a number of articles. The carton may include a top wall, a pair of sidewalls, a rear wall, and a dispenser section. The dispenser section may extend along a top wall portion of the top wall, a side wall portion of each of the pair of sidewalls, and the rear wall.

The present application and the resultant patent further provide a blank for use in erecting a carton. The blank may include a top panel and a pair of side panels with side panel flaps separated by a tear line. A dispensing flap may extend along the top panel, the side panels, and the tear lines separating the side panels and the side panel flaps.

The present application and the resultant patent further provide a carton. The carton may include a top wall, a pair of sidewalls, a rear wall, a dispensing flap, and a number of articles therein. The dispensing flap may extend along the top wall, the pair of sidewalls, and the rear wall.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
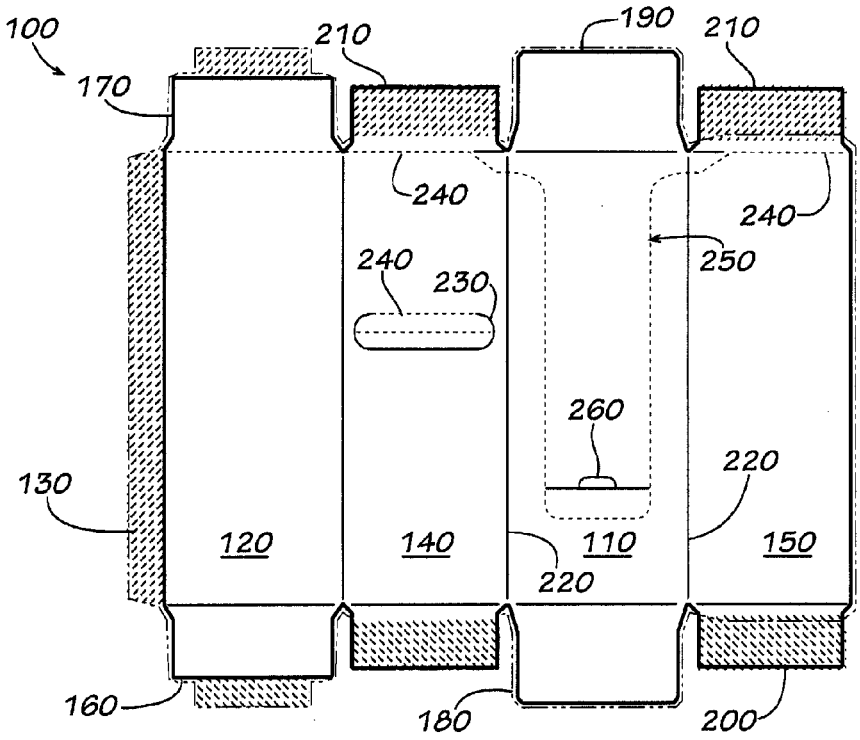
FIG. 1 is a plan view of a carton blank as may be described herein.

Referring now to the drawings, in which like numerals indicate like elements throughout the several views, FIG. 1 shows a blank 100 that may be used to erect cartons as may be described herein. The blank 100 may be made out of cardboard, paperboard, corrugated board, or other types of foldable sheet materials. Various types of polymers and laminates also may be used. Specifically, the blank 100 may be made out of coated unbleached paperboard. The blank 100 may be die cut from a continuous sheet of material or from individual sheets. Other types of materials and other types of construction techniques also may be used herein. The terms "lower," "bottom," "upper," "top," and the like indicate relative orientations determined in relation to fully erected cartons as opposed to absolute positions.

Each blank 100 may have a number of fold lines and/or tear lines formed therein. The term "fold line" may refer to any type of weakened line that facilitates folding of the material along the length of the line. The fold line may include, but is not limited to, a score line, an embossed line, a debossed line, a perforation, a line of short slits, a line of half cuts, a combination of slits and score lines, and similar arrangements. Any reference to a fold line or any type of hinged connection should not be construed as being limited to a single fold line. As such, a fold line or a hinged connection may be formed from one or more fold lines. The term "tear" line may refer to a line of severance or other type of weakened line that facilitates tearing or separation along the length of the weakened line. The tear line may include, but is not limited to, a perforation, a line of short slits, a line of half cuts, a combination of slits and score lines, and similar arrangements. Moreover, a line of perforations, for example, may have different degrees of weakness so as to define a fold line and/or a tear line.

The blank 100 may have a number of panels and flaps separated by the fold lines and/or the tear lines. Specifically, the blank 100 may have a top panel 110, a bottom panel 120, a bottom flap 130, and a pair of side panels, a first side panel 140 and a second side panel 150. The bottom panel 120 may have a pair of bottom panel flaps, a first bottom panel flap 160 and a second bottom panel flap 170. Likewise, the top panel 110 may include a pair of top panel flaps, a first top panel flap 180 and a second top panel flap 190. Each side panel 140, 150 also may have a side panel first flap 200 and a side panel second flap 210. Other types of panels and flaps also may be used herein in other shapes and configurations.

The first and/or the second side panels 140, 150 may have a handle cutout 230 formed approximately in the lengthwise middle thereof. The handle cutout 230 may be defined by a number of tear lines 240 therein so as to provide ease of penetration and access therein.

The blank 100 also may include a dispensing flap 250 formed therein by a number of fold lines 220 and/or tear lines 240. The dispensing flap 250 may extend along a portion of the length of the top panel 110 and into a portion of each of the side panels 140, 150. The dispensing flap 250 then may continue along the fold lines 220 between the side panels 140, 150 and the side panel second flaps 210. The dispensing flap 250 may include a thumb guide 260 closer to the first top flap 180. The thumb guide 260 may be in combination of fold lines 220 and tear lines 240. As the dispensing flap 250 extends towards the second top flap 190, the tear lines 240 may take any desired shape, contour, or path. Other shapes and other types of contours also may be used herein.

The dispensing flap 250 may flare outward towards the second top flap 190 and cut an upper corner defined by the top panel 110, the side panels 140, 150, and the tear lines 240 between the side panels 140, 150 and the side panel second flaps 210. The dispensing flap 250 then may continue downward towards the bottom panel 120. Other shapes and configurations may be used herein. Likewise, the specific dimensions of the blank 100 and the component panels, flaps, fold lines, tear lines, and the like may vary herein.

Figure 2:
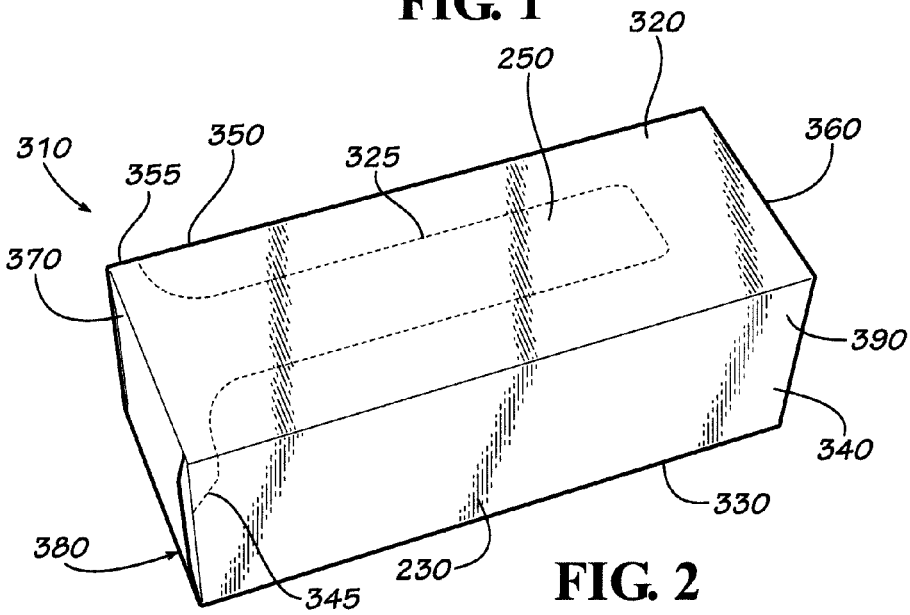
FIG. 2 is a perspective view of a carton erected from the carton blank of FIG. 1.
Figure 3:
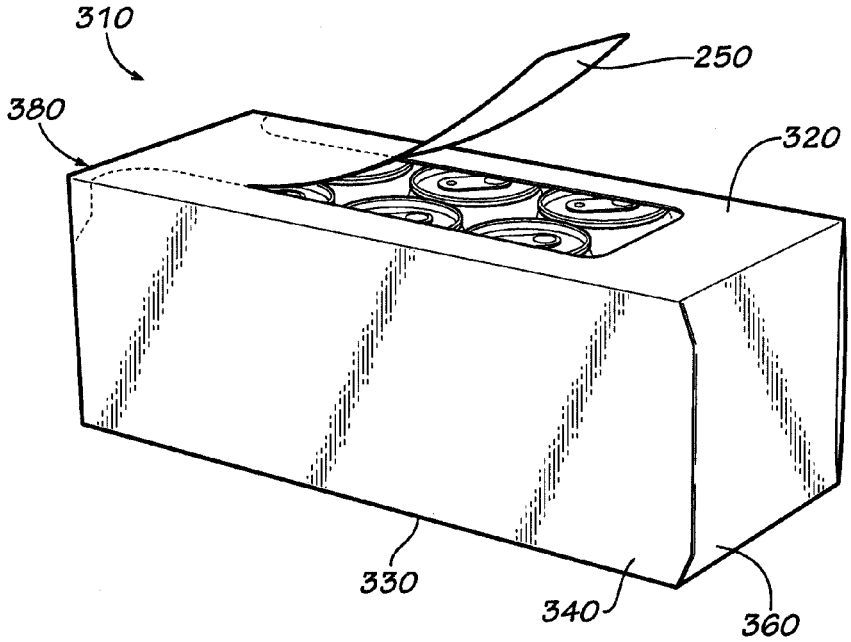
FIG. 3 is a perspective view of the carton of FIG. 2 with the dispenser section partially opened.
Figure 4:
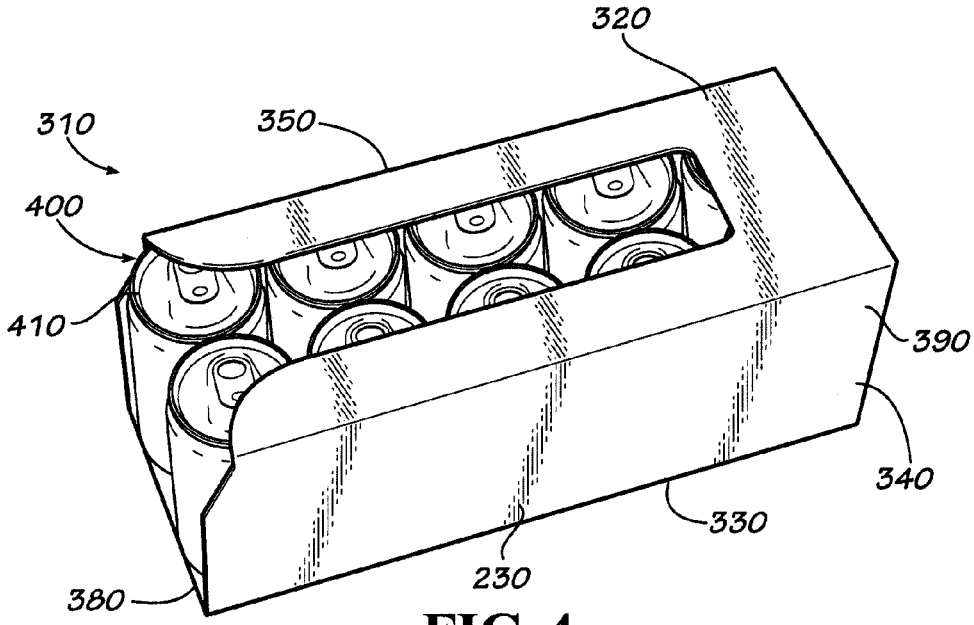
FIG. 4 is a perspective view of the carton of FIG. 2 with the dispenser section removed.

FIGS. 2-4 show a carton 310 as may be described herein. The carton 310 may be erected from the blank 100 as described above and from similar designs. The carton 310 may include a top wall 320 defined by the top panel 110, a bottom wall 330 defined by the bottom panel 120, a first side wall 340 defined by the first side panel 140, and a second sidewall 350 defined by the second side panel 150. The carton 310 also may include a front wall 360 defined by the first bottom flap 160, the first top flap 180, and the side panel first flaps 200. Likewise, the carton 310 may include a back wall 370 defined by the second bottom flap 170, the second top flap 190, and the side panel second flaps 210. As described above, the terms "top," "bottom," "front," "back," and the like reflect relative orientations and not absolute positions. An amount of a glue, an adhesive, or other type of conventional joinder means may be used herein.

The carton 310 also may include a dispenser section 380. The dispenser section 380 may be defined by the dispensing flap 250 described above. The dispenser section 280 thus extends along a top wall portion 325 of the top wall 320, cuts the top corner along the a first sidewall portion 345 of the first sidewall 340 and a second sidewall portion 355 of the second sidewall 350, and results in the back wall 370 being removed. The back wall 370 may be removed in whole or in part. Other shapes, sizes, and configurations may be used herein. Any type of advertising indicia and/or other types of messaging may be positioned about the carton 310.

The carton 310 may be filed with a number of articles 400. The articles 400 may be cans, bottles, or other types of goods that may be positioned within the carton 310. In this example, the articles 400 may be a number of mini-cans 410 as described above. The mini-cans 410 may hold about 7.5 ounces (about 0.22 liters) of a beverage therein. Such mini-cans 410 may have a height of about 4.09 inches (about 10.39 centimeters) and diameter of about 2.24 inches (about 5.69 centimeters). Other sizes, shapes, and configurations may be used herein. The mini-cans 410 may be positioned vertically. The carton 310 may have two (2) product columns in width and five (5) product rows in length for a total of ten (10) mini-cans 410 therein. The carton 310 thus may have a length of about 11.28 inches (about 28.65 centimeters), a width of about 4.49 inches (11.4 centimeters), and a depth of about 4.125 inches (about 10.48 centimeters). Other configurations and other components may be used herein.

In use, the blank 100 may be used to erect the carton 310 as may be described herein. The carton 310 may be loaded with the articles 400 in the form of the mini-cans 410 and the like. The carton 310 may be sealed as appropriate and shipped to a consumer. The consumer may carry the carton 310 along the handle cutout 230. When the consumer desires to access the articles 400 therein, the consumer may open the dispenser section 380 by depressing the thumb guide 260. The dispensing flap 250 may be ripped along the tear lines 240. The dispensing flap 250 may flare out along the sidewalls 340, 350 and then downwards towards the bottom wall 330. The dispensing section 380 may be removed from the carton 310 by removing the rear wall 370 or by leaving the rear wall 370 along the bottom wall 330 thereof.

Once the dispenser section 380 has been opened and/or removed, access to the articles 400 therein may be available along the sidewalls 340, 350 and into the top wall 320. Specifically, a mini-can 410 may be grasped along a side or a top thereof and removed from the carton 310. The carton 310 may be positioned within a conventional refrigerator shelf and the like so as to provide support and ease of access to the articles 400 therein.

The entire rear wall 370 may be removed herein. Conventional containers generally left some portion of the rear wall 370 intact to prevent the articles 400 therein from rolling out given their horizontal orientation. Here, the mini-cans 410 may be vertically positioned such that rolling is not a concern, i.e., the mini-cans 410 may stand up in the vertical position as is shown. Other configurations and other components may be used herein.

Figure 5:
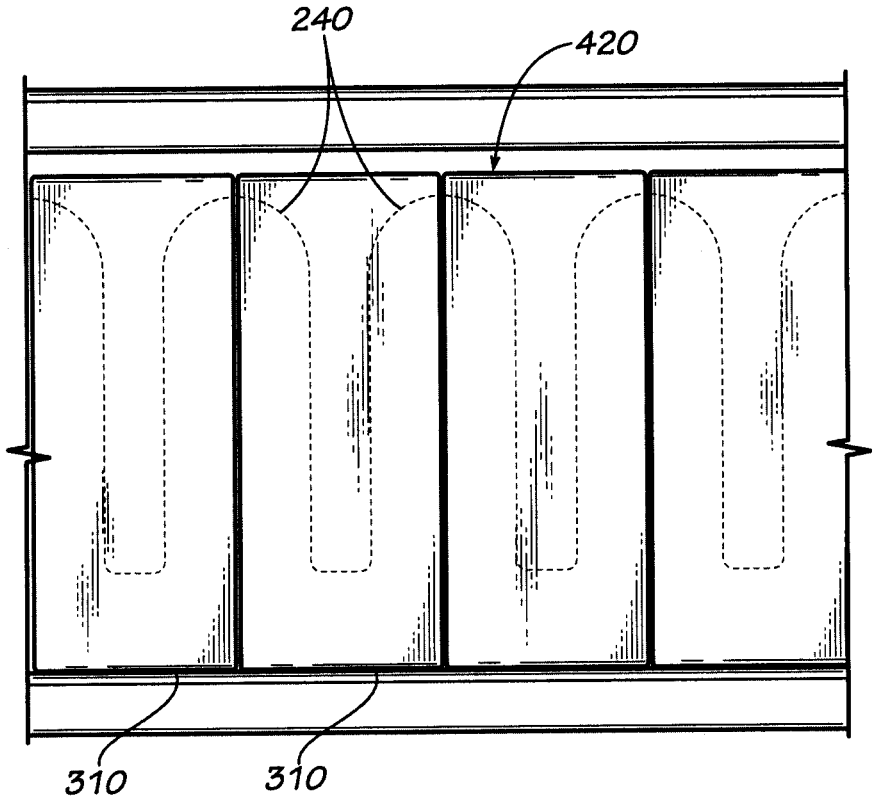
FIG. 5 is a top plan view of a number of cartons positioned adjacent to each other.

As described above, the cartons 310 may have advertising indicia thereon. As is shown in FIG. 5, the tear lines 240 of the dispenser sections 380 of adjacent cartons 310 may appear to merge such that a continuous image 420 may be created. Such a continuous image 420 may be created by aligning a number of cartons 310 adjacent to each other. The continuous image 420 may serve to catch the eye of the consumer. Moreover, similar continuous images 420 also may be formed along the sidewalls 340, 350, the front wall 360, the back wall 370, and/or otherwise. The continuous image 420 also may be contoured or shaped so as to promote the articles 400 and the associated brands therein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof

We claim:

1. A carton for a number of articles, comprising:

a top wall having a length and a width;

a pair of sidewalls positioned on opposite sides of the top wall and extending along the length of the top wall;

a back wall; and a dispenser section comprising a dispenser flap that comprises all of the back wall;

the dispenser section extending along more than half of the top wall and a side wall portion of each of the pair of sidewalls;

wherein one of the pair of sidewalls comprises an opening for a handle cutout, such that the handle cutout is positioned within the one of the pair of sidewalls.

2. The carton of claim 1, wherein the dispensing flap comprises a first side wall portion and a second side wall portion.

3. The carton of claim 1, wherein the dispenser section comprises a thumb guide therein.

4. The carton of claim 1, wherein the back wall comprises a bottom panel flap and a top panel flap.

5. The carton of claim 1, wherein the back wall comprises a pair of side panel flaps.

6. The carton of claim 1, wherein the carton comprises a length of about 11.28inches (about 28.65 centimeters), a width of about 4.49 inches (11.4 centimeters), and a depth of about 4.125 inches (about 10.48 centimeters).

7. The carton of claim 1, wherein the carton comprises advertising indicia thereon.

8. The carton of claim 1, further comprising a continuous image extending from a first carton to a second carton.

9. The carton of claim 1, wherein the carton comprises a two (2) by five (5) mini-can configuration in a vertical position.

10. A blank for use in erecting a carton, comprising:

a top panel having a length and a width, the top panel comprising a top panel flap;

a pair of side panels positioned on opposite sides of the top panel and extending along the length of the top panel, wherein one of the pair of side panels comprises an opening for a handle cutout;

each of the pair of side panels comprising a side panel flap separated by a tear line; and a dispensing flap extending along a majority of the top panel and along the side panels and the tear lines separating the side panels and the side panel flaps, wherein the dispensing flap comprises all of the top panel flap;

wherein the opening is disposed within the one of the pair of side panels, such that the handle cutout is positioned within the one of the pair of side panels.

11. The blank of claim 10 wherein the dispensing flap comprises a thumb guide therein.

12. A carton, comprising:

a top wall having a width and a length that is greater than the width;

a pair of sidewalls positioned on opposite sides of the top wall and extending along the length of the top wall, wherein at least one of the pair of sidewalls comprises an opening for a handle cutout, the opening disposed within the one of the pair of sidewalls;

a back wall;

a dispensing flap;

the dispensing flap extending along the top wall and the pair of sidewalls, wherein the dispensing flap comprises all of the back wall; and a plurality of articles therein, wherein the plurality of articles is positioned in the carton such that central axes of the plurality of articles are transverse to the length of the top wall.

13. The carton of claim 12, wherein the plurality of articles comprises a plurality of mini-cans.

14. The carton of claim 12, wherein the plurality of articles comprises a two (2) by five (5) configuration of mini-cans in a vertical position.

* * * * *